US008955279B1

(12) United States Patent
Clairmont et al.

(10) Patent No.: US 8,955,279 B1
(45) Date of Patent: Feb. 17, 2015

(54) RESILIENT CANTILEVERED ATHLETIC FLOORING SYSTEM

(75) Inventors: Douglas A. Clairmont, Crystal Falls, MI (US); Michael J. Mann, Jr., Menominee, MI (US)

(73) Assignee: Aacer Acquisition, LLC, Peshtigo, WI (US)

( * ) Notice: Subject to any disclaimer, the term of this patent is extended or adjusted under 35 U.S.C. 154(b) by 128 days.

(21) Appl. No.: 12/584,037

(22) Filed: Aug. 31, 2009

(51) Int. Cl.
*E04F 15/22* (2006.01)

(52) U.S. Cl.
USPC ..... 52/403.1; 52/480; 52/506.05

(58) Field of Classification Search
USPC ..... 52/403.1, 480, 745.05, 745.06, 745.13, 52/481.1, 506.06, 512; 411/482, 455, 922
See application file for complete search history.

(56) References Cited

U.S. PATENT DOCUMENTS 3,604,173 A * 9/1971 Dahlborg ..... 52/508
3,952,465 A 4/1976 Masiello
4,682,459 A * 7/1987 Stephenson ..... 52/390
4,879,857 A * 11/1989 Peterson et al. ..... 52/403.1
5,299,401 A * 4/1994 Shelton ..... 52/393
5,412,917 A * 5/1995 Shelton ..... 52/403.1
6,367,217 B1 * 4/2002 Niese et al. ..... 52/480
6,557,314 B2 * 5/2003 Shelton ..... 52/480
6,688,065 B2 * 2/2004 Chambers ..... 52/480
7,316,056 B2 * 1/2008 Haytayan ..... 29/432
7,703,252 B2 * 4/2010 Randjelovic ..... 52/403.1
7,735,280 B2 * 6/2010 Valentine ..... 52/403.1
2004/0098926 A1 * 5/2004 Haytayan ..... 52/40
2005/0193670 A1 * 9/2005 Niese et al. ..... 52/403.1
2008/0104915 A1 5/2008 Randjelovic

* cited by examiner

*Primary Examiner* — Jeanette E. Chapman
(74) *Attorney, Agent, or Firm* — Greenberg Traurig, LLP

(57) ABSTRACT

A resilient cantilevered athletic flooring system wherein a multiplicity of flexible rectangular panels having an anchor strip secured under the panels along the longitudinal centerline of the panels and multiple nailer strips attached to the top of the panels and to either side of the centerline and multiple resilient pads secured to the underside of the panel under the nailer strips and the panels are secured to a prepared base by passing anchors through the panels and the anchor strips. Multiple panels are secured side by side and end to end to cover the flooring venue and a wear floor is secured to the nailer strips to complete the installation.

12 Claims, 4 Drawing Sheets

RESILIENT CANTILEVERED ATHLETIC FLOORING SYSTEM

BACKGROUND OF THE INVENTION

1. Field of the Invention

This invention relates to flooring systems.

More specifically, this invention relates to flooring systems used for athletic floors.

Still more specifically, this invention relates to flooring systems as described above wherein the flooring systems are certifiable under DIN, EN, and FIBA certification requirements.

Still more specifically, this invention relates to flooring systems as described above wherein the flooring system is provided with a novel cantilevered subflooring module that is economical to assemble away from the installation venue, economical to transport to the installation venue and economical to install at the installation venue.

2. Description of the Related Art

Modern hardwood athletic floors are typically installed upon a subfloor that provides the athletic flooring system with desirable attributes that are not obtainable when the flooring is attached directly to a base or to a sleeper attached to the base. The desired attributes are related to resilience that eases the impact shock when running or jumping while preserving the inertial stability that produces the most desirable ball rebound. It is also desired that the flooring system minimize vibration and wave transmission and trough formation under rolling loads. Modern athletic flooring systems are measured for these and other properties and certified as meeting industry standards by the DIN and FIBA associations. It is also desirable that the flooring system be ventilateable to deal with moisture accumulating between the floor and the base. The flooring system of this invention can meet all of the above product requirements and standards.

The wear surface of hardwood athletic floors is generally uniform in quality and cost throughout the industry. The economics of the business relates to the costs associated with fabricating, transporting and installing the subfloor. The subfloor of the flooring system of this invention employs novel cantilevered flooring modules that employ minimal amounts of fabricating materials that can be assembled away from the job site and the modules stack neatly for transportation and the modules can be handled and installed by a single installer in a short period of time making the subflooring of this invention competitive with prior art flooring systems in quality while providing the flooring system of this invention with cost advantages over prior art flooring systems.

The prior art provides cantilevered porch decks and hallway floors. The cantilevered construction is not intended to provide resilience and is not associated with subflooring construction. U.S. Pat. No. 3,952,465 to Masiello is one such patent.

The patent art abounds in subflooring modules some of which are joined together by nailer strips. U.S. patent number U.S.2008/0104915 to Randjelovic is one such patent.

An athletic flooring system that employs a subflooring module having the cantilevered construction taught in these specifications is believed to be novel in the athletic flooring art.

BRIEF DESCRIPTION OF THE INVENTION

The invention is for a cantilevered resilient athletic flooring system comprising; a prepared base; a multiplicity of cantilevered subflooring modules having a flexible rectangular panel, the panel having a length that is greater than its width, a longitudinal centerline, a top surface, a bottom surface, a first end, a second end, a first side, and a second side; an anchor strip secured to the bottom surface of the panel along the longitudinal centerline of the panel; a multiplicity of anchor ports passing through the panel and the anchor strip and the ports are spaced apart along the centerline of the panel; a multiplicity of nailer strips secured to the top surface of the panel and the nailer strips are laid parallel to the longitudinal centerline of the panel and there are an equal number of nailer strips to either side of the centerline of the panel; a multiplicity of discrete resilient pads secured to the bottom of the panel below the nailer strips and the pads are spaced apart along lines parallel to the longitudinal centerline of the panel; anchors passing through the anchor ports and securing the modules to the base: and the modules are joined end to end and are spaced apart a short distance side to side; a wear surface attached to the nailer strips.

DETAILED DESCRIPTION OF THE INVENTION

Figure 1:
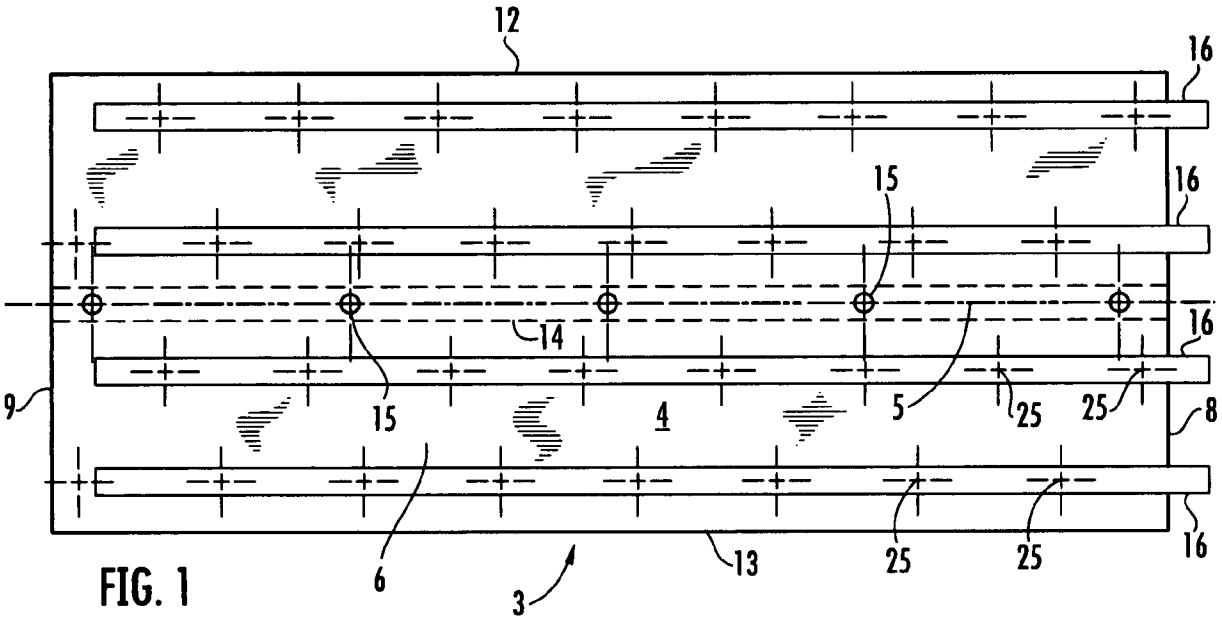
FIG. 1 is a plan view of a module of this invention.

In the drawings like numbers refer to like objects and some of the proportions of some of the elements have been modified to facilitate illustration.

The term "cantilever" as used herein shall be understood to mean "a long projecting beam or girder fixed at only one end".

Referring now to FIGS. 1 through 6. The invention is for a cantilevered resilient athletic flooring system 1 comprising; a prepared base 2; a multiplicity of cantilevered subflooring modules 3 having a flexible rectangular panel 4, panel 4 having a length that is greater than its width, a longitudinal centerline 5, a top surface 6, a bottom surface 7, a first end 8, a second end 9, a first side 12, and a second side 13; an anchor strip 14 secured to the bottom surface 7 of panel 4 along the longitudinal centerline 5 of panel 4; a multiplicity of anchor ports 15 passing through panel 4 and anchor strip 14 and ports 15 are spaced apart along the centerline 5 of the panel 4; a multiplicity of nailer strips 16 secured to the top surface 6 of panel 4 and the nailer strips 16 are laid parallel to the longitudinal centerline 5 of panel 4 and there are an equal number of nailer strips 16 to either side of the centerline 5 of panel 4; a multiplicity of discrete resilient pads 17 secured to the bottom surface 7 of panel 4 below nailer strips 16 and pads 17 are spaced apart along lines parallel to the longitudinal centerline 5 of panel 4; anchors 18 passing through anchor ports 15 and securing modules 3 to base 2: and the modules 3 are joined first end 8 to second end 9 and are spaced apart a short distance between first side 12 and second side 13; a wear surface 19 is attached to the nailer strips 16.

Figure 2:
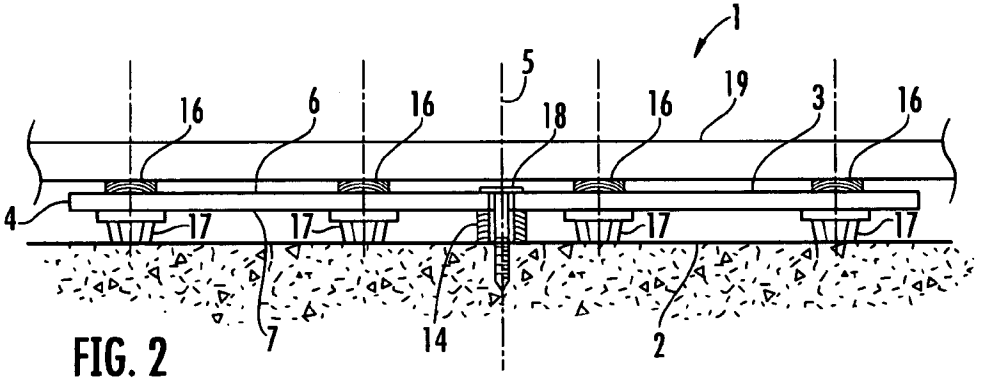
FIG. 2 is a cross sectional elevation view of the module of FIG. 1 secured to a base and having a wear surface attached to the nailer strips of the module.
Figure 4:
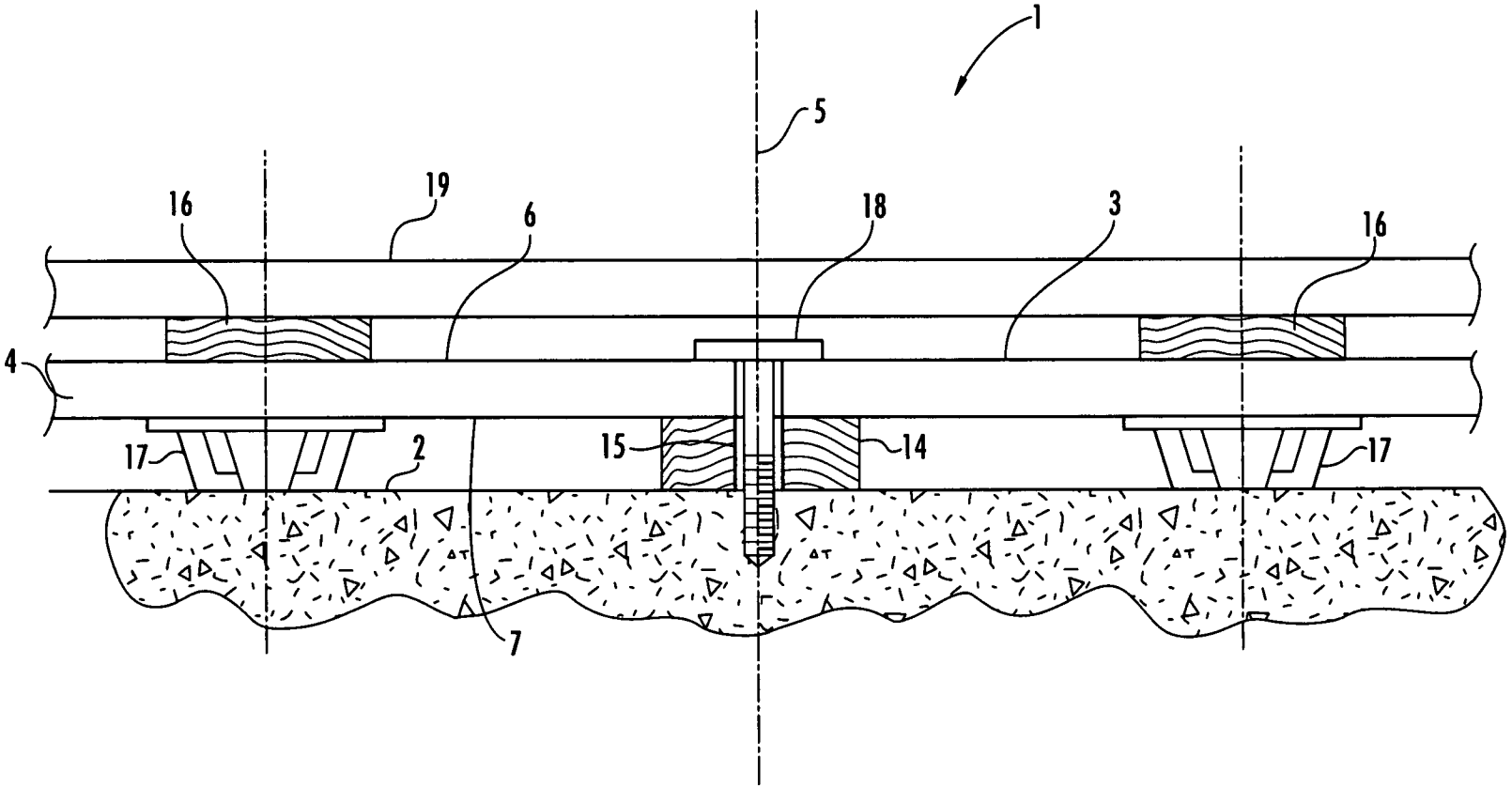
FIG. 4 is an enlarged cross sectional view of an anchor portion of the flooring system illustrating how the cantilevered panel works with the resilient pads to provide a resilient flooring system.

As shown in FIGS. 2 and 4, flexible rectangular panel 4 is attached to anchor strip 14 and the assembly is secured to base 2 by means of anchors 18. The sides of panel 4 to either side of anchor strip 14 are cantilevered from anchor strip 14 and would flex downward were they not supported by resilient pads 17 secured to the bottom surface 7 of panel 4. Nailer strips 16 are secured to the top surface 6 of panel 4 above resilient pads 17. A wear surface 19 typically made of strips of hardwood is attached to the nailer strips 16. A load on wear surface 19 is transmitted through nailer strips 16 and flexible rectangular panel 4 to resilient pad 17 thereby imparting to wear surface 19 the desired resilient properties. It should be noted that a load placed directly over anchor strip 14 would be transmitted to nailer strips 16 to either side of anchor strip 14 and it can be seen that the cantilevered flooring system 1 of this invention is capable of providing a uniform degree of resilience over the area of flooring system 1.

The above disclosures are enabling and would permit one skilled in the art to make and use the invention for its intended purposes without undue experimentation.

The degree of resilience of flooring system can be "tuned" by changing the composition and spacing of resilient pads 17 and the degree of flexibility in the rectangular panel 4. Changes in the sizing and spacing of nailer strips 16 can also change the certification properties of flooring system 1.

The best mode of practicing the invention known to the inventors at the time of this disclosure is as follows:

Prepared Base (2):
Concrete
Wear surface (19):
25/32 inch by 2¼" Random length hardwood strips
Cantilevered subflooring module (3):
Rectangular panel, (4)
three feet by eight feet by ⅜ inch, plywood
Nailer strips (16)
one half inch by two inch by eight feet, wood
Anchor strip, (14)
three fourths inch by two inch by eight feet, wood
Resilient Pads, (17)
molded EPDM Rubber
Anchors, (18)
¼ inch dia. steel concrete anchorments Cantilevered subflooring module 3 can be assembled by a single person and can be installed by a single person. The labor costs associated with module 3 are minimal. The materials costs associated with module 3 are minimal. Module 3 can be stacked and transported conveniently.

Nailer strips 16 are secured parallel to centerline 5 of panel 4 with two strips to either side of centerline 5. Nailer strips 16 are spaced apart with 10 inches between centers. This provides 3 inches between the centerlines of outside nailer strips 16 and first side 12 and second side 13 (see FIG. 3). A space between sides 12 and 13 of four inches produces a flooring system wherein parallel nailer strips are positioned 10 inches apart over the area of the flooring venue.

Figure 3:
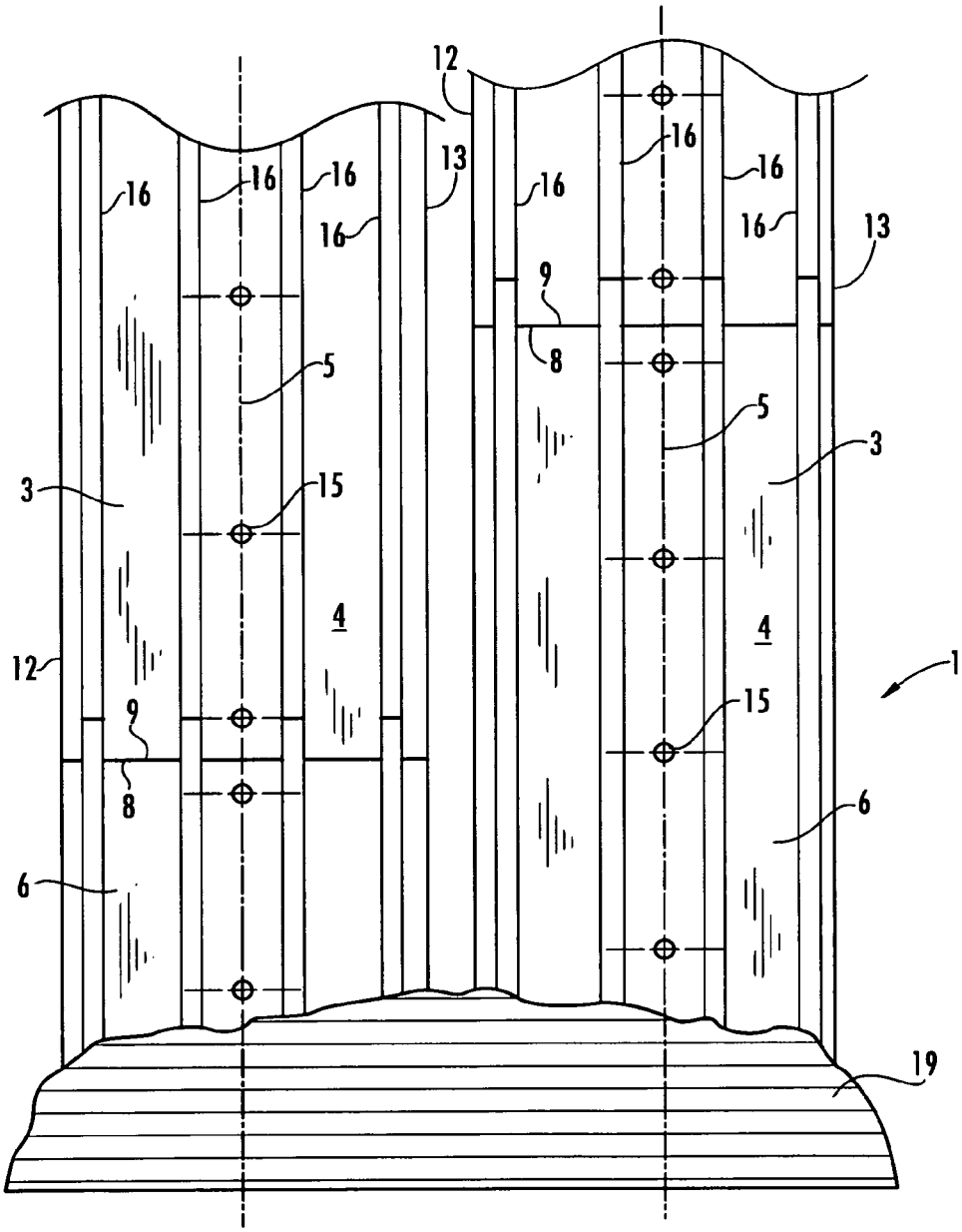
FIG. 3 is a fragmentary plan view of the flooring system of this invention.

Nailer strips 16 are attached to panel 4 with about four inches projecting beyond first end 8 of panel 4. When modules 3 are laid end to end with a gap of between 1/32 and ⅛ inches between first end 8 and second end 9 as shown in FIG. 3 and the ends of nailer strips 16 of one panel are secured to the ends of the abutting panel, and modules 3 are as described above are spaced apart a distance of four inches, flooring system 1 is provided with equally spaced apart parallel nailer strips over the area of the flooring venue.

In preferred embodiments of the invention, resilient pads 17 are shown to be of a pad design invented by the inventors and are the subject of co-pending design patent application Ser. No. 29/313,571 now U.S. Design Pat. No. D598,691.

Figure 5:
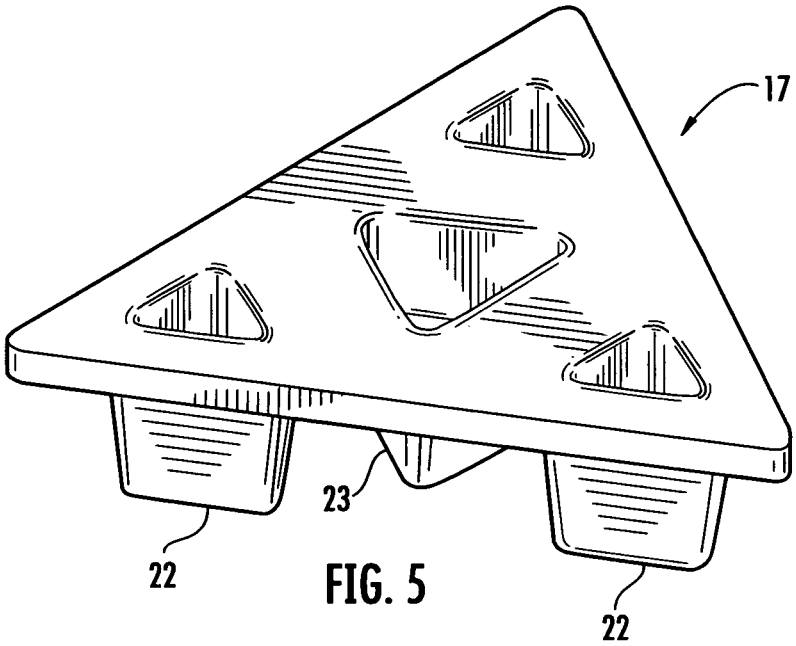
FIG. 5 is a top perspective view of a preferred resilient pad.
Figure 6:
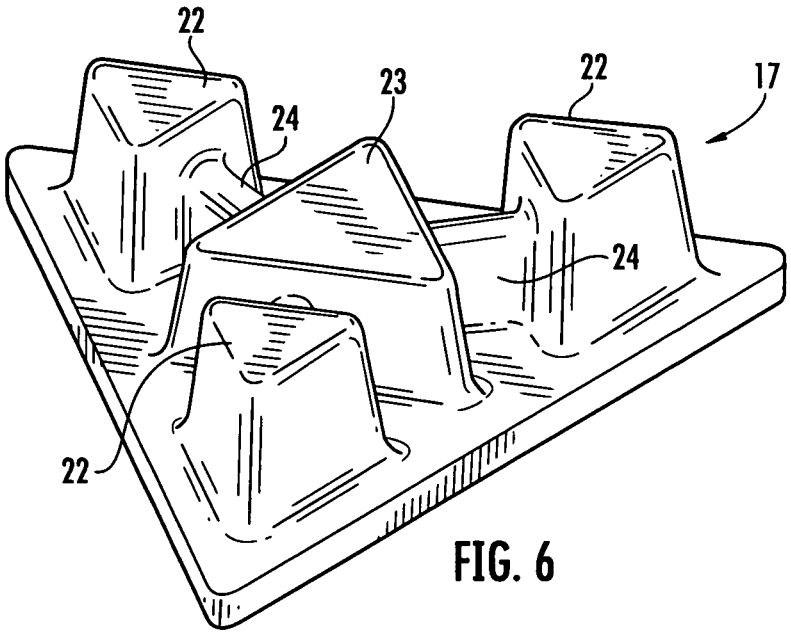
FIG. 6 is a bottom perspective view of the pad of FIG. 5.

In FIGS. 5 and 6 pad 17 is shown to be of triangular shape having three corner posts 22 in the shape of a hollow frustum of a triangular pyramid, a central support 23 in the shape of a hollow frustum of pyramid that is shorter than posts 22 and posts 22 are attached to support 23 by means of webs 24. Pads 17 are formed of molded EPDM rubber.

Pads 17 are secured to bottom surface 7 of panel 4 along lines parallel to the longitudinal centerline 5 of panel 4 and under nailer strips 16. Pads 17 are evenly spaced apart on pad centers 25 as shown is FIG. 1. Pad centers 25 are staggered in alternate rows to provide flooring system 1 with a uniform distribution of resilient pads 17 over the area of the venue of flooring system 1.

The uniform spacing of nailer strips 16 and of resilient pads 17 provides flooring system 1 with a high degree of point to point uniformity of resilience and ball rebound properties. The provision of side to side and end to end gaps betweens modules 3 along with the anchoring of panel 4 to base 2 provides flooring system 1 with a resistance to propagation of vibrations, waves and troughs which are desirable attributes in athletic flooring systems.

It should be understood that variations in the dimensions and materials of the above disclosed flooring system are within the scope of this invention and that the scope of this invention should not be limited to the scope of the embodiments disclosed above. The scope of this invention should only be limited by the scope of the appended claims and all equivalents thereto that would be made apparent thereby.

What is claimed is:

1. A cantilevered resilient athletic flooring system comprising:

a prepared base;

a multiplicity of rectangular resilient cantilevered subflooring modules, each of the rectangular resilient cantilevered subflooring modules comprising:

a flexible rectangular panel having a top surface, a bottom surface, a longitudinal centerline, a length, a width, a first end, a second end, a first side, and a second side, wherein the length is greater than the width, a multiplicity of nailer strips attached to the top surface and parallel to the longitudinal centerline, wherein the multiplicity of nailer strips are laid parallel to the longitudinal centerline of the flexible rectangular panel, with there being an equal number of nailer strips to either side of the longitudinal centerline of the flexible rectangular panel, a multiplicity of discreet resilient pads spaced apart, the multiplicity of discreet resilient pads attached to the bottom surface of the flexible rectangular panel below the nailer strips, wherein the multiplicity of discrete resilient pads are spaced apart along lines parallel to the longitudinal centerline of the flexible rectangular panel, an anchor strip secured to the bottom surface of the flexible rectangular panel along the longitudinal centerline of the flexible rectangular panel, wherein the flexible rectangular panel is anchored to the base by anchors passing through the flexible rectangular panel and through the anchor strip and secured in the base, wherein the anchor strip is rigid, wherein the anchor strip and the anchors vertically fix the flexible rectangular panel at the longitudinal centerline, a wear surface attached to the nailer strips, and a multiplicity of anchor ports passing through the flexible rectangular panel and the anchor strip, wherein the multiplicity of anchor ports are spaced apart along the longitudinal centerline of the panel, wherein multiple flexible rectangular panels are joined end to end and spaced apart side to side;

wherein the first end of the flexible rectangular panel is spaced apart from a second end of an adjacent flexible rectangular panel a distance of at least 1/32 inch and the first side of the flexible rectangular panel is spaced apart from a second side of another adjacent flexible rectangular panel a distance that places all the nailer strips on the flexible rectangular panels parallel and equidistant apart.

2. A cantilevered resilient athletic flooring system comprising:

a prepared base;

a flexible rectangular panel having a length, a width, a longitudinal centerline, a top surface, a bottom surface, a first end, a second end, a first side, and a second side, wherein the length is greater than the width;

an anchor strip secured to the bottom surface of the flexible rectangular panel along the longitudinal centerline of the flexible rectangular panel, wherein the anchor strip is rigid, wherein the anchor strip and anchors vertically fix the flexible rectangular panel at the longitudinal centerline;

a multiplicity of anchor ports passing through the flexible rectangular panel and the anchor strip, wherein each of the multiplicity of anchor ports is spaced apart along the centerline of the flexible rectangular panel, wherein the flexible rectangular panel is anchored to the prepared base by passing the anchors through the ports and securing them in the base;

a multiplicity of nailer strips secured to the top surface of the flexible rectangular panel, each of the multiplicity of nailer strips being laid parallel to the longitudinal centerline of the flexible rectangular panel, there being an equal number of nailer strips to either side of the longitudinal centerline of the flexible rectangular panel;

a multiplicity of discrete resilient pads secured to the bottom surface of the flexible rectangular panel below each of the multiplicity of nailer strips, wherein the discrete resilient pads are spaced apart along lines parallel to the longitudinal centerline of the flexible rectangular panel; and a wear surface attached to the multiplicity of nailer strips, wherein each of the multiplicity of nailer strips are the same length as the flexible rectangular panel and are spaced apart an equal distance to either side of the longitudinal centerline of the flexible rectangular panel, each of the multiplicity of nailer strips being spaced apart an equal distance from each other and the nailer strips extending beyond the first end of the flexible rectangular panel so as to overlap a second end of an adjacent flexible rectangular panel a distance of at least 2 inches, wherein the first end of the flexible rectangular panel is spaced apart from the second end of the adjacent flexible rectangular panel a distance of at least 1/32 inch, wherein the first side of the flexible rectangular panel is spaced apart from a second side of another adjacent flexible rectangular panel a distance that places all the nailer strips on the flexible rectangular panels parallel and equidistant apart, wherein each of the multiplicity of resilient pads has a triangular shape, wherein each of the multiplicity of resilient pads is provided with a corner post at each corner of the triangular shape and each of the corner posts is in the form of a frustum of a triangular pyramid.

3. A cantilevered subflooring module comprising:

a flexible rectangular panel including a top surface, a bottom surface, a first end, a second end, a first side, and a second side, wherein a longitudinal centerline extends halfway between the first and second sides;

a plurality of nailer strips attached to the top surface of the flexible rectangular panel;

a plurality of resilient pads attached to the bottom surface of the flexible rectangular panel beneath the plurality of nailer strips;

a rigid anchor strip attached to the bottom surface of the flexible rectangular panel at the longitudinal centerline, wherein anchor ports in the flexible rectangular panel and anchor ports in the rigid anchor strip are aligned; and anchors extending through the anchor ports in the flexible rectangular panel and through the anchor ports in the anchor strip to secure the rigid anchor strip and the flexible rectangular panel to a prepared base.

4. The cantilevered subflooring module of claim 3 wherein the anchors and the rigid anchor strip vertically and horizontally fix the flexible rectangular panel near the centerline; wherein a first portion of the flexible rectangular panel between the rigid anchor strip and the first side is not fixed, but is supported by one or more of the plurality of resilient pads; wherein a second portion of the flexible rectangular panel between the rigid anchor strip and the second side is not fixed, but is supported by one or more of the plurality of resilient pads.

5. The cantilevered subflooring module of claim 4 wherein the plurality of nailer strips extend beyond the first end of the flexible rectangular panel.

6. The cantilevered subflooring module of claim 4 wherein each of the plurality of resilient pads has a triangular shape, wherein each of the plurality of resilient pads is provided with a corner post at corners of the triangular shape, the corner post being in the form of a frustum of a triangular pyramid.

7. The cantilevered subflooring module of claim 4 wherein the rigid anchor strip comprises wood.

8. The cantilevered subflooring module of claim 4 wherein the flexible rectangular panel comprises plywood.

9. The cantilevered subflooring module of claim 4 wherein the plurality of resilient pads comprise EPDM rubber.

10. The cantilevered subflooring module of claim 4 wherein the anchor ports in the flexible rectangular panel are spaced apart along the longitudinal centerline.

11. The cantilevered subflooring module of claim 10 wherein the plurality of resilient pads are spaced apart along lines parallel to the longitudinal centerline.

12. The cantilevered subflooring module of claim 11 wherein the plurality of nailer strips are positioned along the lines parallel to the longitudinal centerline.

* * * * *